US011144009B2

(12) United States Patent
Mizutani

(10) Patent No.: US 11,144,009 B2
(45) Date of Patent: Oct. 12, 2021

(54) TONER COLLECTION DEVICE INCLUDING FAN UNIT AND IMAGE FORMING APPARATUS

(71) Applicant: KYOCERA Document Solutions Inc., Osaka (JP)

(72) Inventor: Naoki Mizutani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/827,909

(22) Filed: Mar. 24, 2020

(65) Prior Publication Data

US 2020/0326654 A1 Oct. 15, 2020

(30) Foreign Application Priority Data

Apr. 9, 2019 (JP) ..... JP2019-074262

(51) Int. Cl.

| | |
|---|---|
| ***G03G 21/20*** | (2006.01) |
| ***G03G 21/10*** | (2006.01) |
| ***G03G 15/08*** | (2006.01) |
| ***G03G 21/00*** | (2006.01) |
| ***G03G 21/12*** | (2006.01) |

(52) U.S. Cl.

CPC ..... *G03G 21/206* (2013.01); *G03G 15/0844* (2013.01); *G03G 21/0052* (2013.01); *G03G 21/10* (2013.01); *G03G 21/105* (2013.01); *G03G 21/12* (2013.01); *G03G 21/20* (2013.01); *G03G 2221/0021* (2013.01); *G03G 2221/0052* (2013.01); *G03G 2221/1618* (2013.01); *G03G 2221/1627* (2013.01); *G03G 2221/1645* (2013.01)

(58) Field of Classification Search

CPC ..... G03G 15/0844; G03G 21/0052; G03G 21/10; G03G 21/105; G03G 21/12; G03G 21/20; G03G 21/206; G03G 2221/0021; G03G 2221/0052; G03G 2221/1618; G03G 2221/1627; G03G 2221/1645

See application file for complete search history.

(56) References Cited

U.S. PATENT DOCUMENTS

| | | | | |
|---|---|---|---|---|
| 9,188,952 | B2 | 11/2015 | Inui et al. | |
| 2015/0023686 | A1* | 1/2015 | Mukataka | G03G 21/206 399/93 |
| 2015/0117895 | A1* | 4/2015 | Yoneda | G03G 21/10 399/99 |
| 2018/0147517 | A1* | 5/2018 | Kurita | B01D 46/0001 |

FOREIGN PATENT DOCUMENTS

| | | | |
|---|---|---|---|
| JP | 2014-191342 | A | 10/2014 |

* cited by examiner

*Primary Examiner* — Joseph S Wong

(74) *Attorney, Agent, or Firm* — Studebaker & Brackett PC

(57) ABSTRACT

A toner collection device includes a casing, a fan unit and a filter. The casing has a suction port and an exhaust port. The fan unit is supported by the casing in a swingable manner and generates an air flow from the suction port to the exhaust port inside the casing. The filter is disposed inside the casing and supported by the casing or the fan unit, and collects a toner contained in the air flow flowed into the casing through the suction port. When the fan unit is driven to generate the air flow, a swinging of the fan unit is transmitted to the filter to vibrate the filter.

8 Claims, 9 Drawing Sheets

TONER COLLECTION DEVICE INCLUDING FAN UNIT AND IMAGE FORMING APPARATUS

INCORPORATION BY REFERENCE

This application is based on and claims the benefit of priority from Japanese patent application No. 2019-074262 filed on Apr. 9, 2019, which is incorporated by reference in its entirety.

BACKGROUND

The present disclosure relates to a toner collection device and an image forming apparatus.

Some toner collection units are provided with a casing having an inflow port, a first fan disposed inside the casing and sucking air flow and exhausting it to the outside of the casing, and a first filter collecting a toner and passing the air flow. Furthermore, a vibration motor to vibrate the first filter may be provided. By vibrating the first filter using the vibration motor, the toner collected by the first filter falls to prevent the clogging of the first filter.

However, in the above described toner collection unit, in order to vibrate the first filter, it is necessary to provide the vibration motor, and manufacturing costs increase. Additionally, in order to provide a space for setting the vibration motor, the toner collection unit is increased in size.

SUMMARY

In accordance with an aspect of the present disclosure, a toner collection device includes a casing, a fan unit and a filter. The casing has a suction port and an exhaust port. The fan unit is supported by the casing in a swingable manner and generates an air flow from the suction port to the exhaust port inside the casing. The filter is disposed inside the casing and supported by the casing or the fan unit, and collects a toner contained in the air flow flowed into the casing through the suction port. When the fan unit is driven to generate the air flow, a swinging of the fan unit is transmitted to the filter to vibrate the filter.

In accordance with an aspect of the present invention, an image forming apparatus includes the toner collection device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an embodiment of the present disclosure will be described with reference to the attached drawings. "Fr", "Rr", "L" and "R" shown in each figure indicate "front", "rear", "left" and "right" respectively. An upper-and-lower direction is an example of "an axial direction" and a radial direction along a plane perpendicular to the upper-and-lower direction is an example of "a radial direction". Although terms showing directions and positions are used in the specification, these terms are used for convenience for explanation and not limited to the technical scope of the present disclosure.

Figure 1:
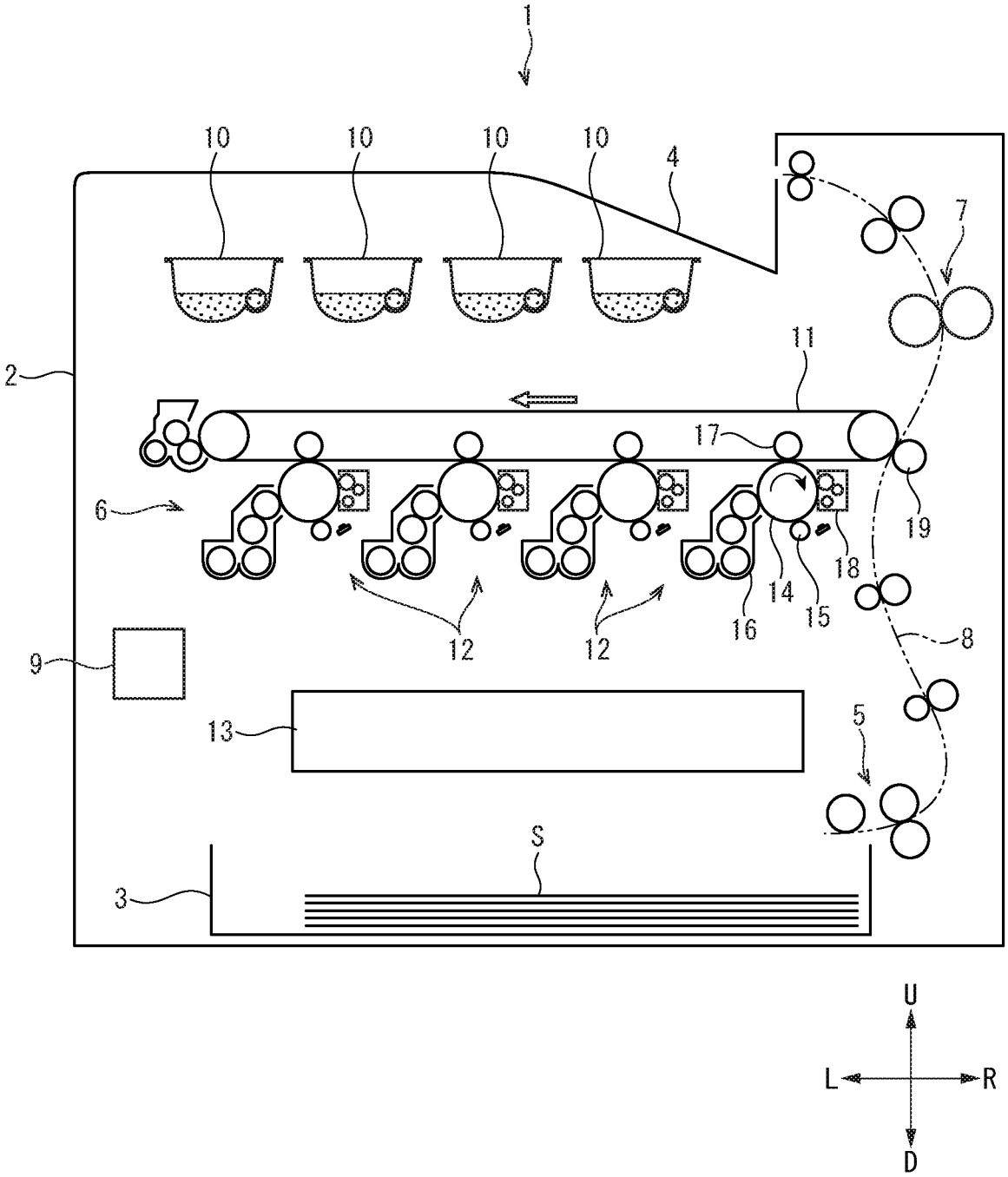
FIG. 1 is a front view schematically showing an inner structure of a color printer according to one embodiment of the present disclosure.

[Outline of color printer] With reference to FIG. 1, a color printer 1 as an example of an image forming apparatus will be described. FIG. 1 is a front view schematically showing an inner structure of the color printer 1.

The color printer 1 includes an apparatus main body 2 having an approximately parallelepiped exterior shape. In the lower portion of the apparatus main body 2, a sheet feeding cassette 3 in which a paper sheet S (a medium) is stored is provided in an attachable and detachable manner. On the upper face of the apparatus main body 2, a discharge tray 4 is provided.

The color printer 1 includes a sheet feeding device 5, an image forming device 6 and a fixing device 7 which are provided in the apparatus main body 2. The sheet feeding device 5 is provided at an upstream end portion of a conveyance path 6 extending from the sheet feeding cassette 3 to the discharge tray 4. The fixing device 7 is provided at the downstream side portion of the conveyance path 8 and the image forming device 6 is provided between the sheet feeding device 5 and the fixing device 7 on the conveyance path 8.

The image forming device 6 includes four toner containers 10, an intermediate transferring belt 11, four drum units 12 and an optical scanning device 13. The respective four toner containers 10 store toners (developer) of four colors (yellow, magenta, cyan and black). The drum unit 12 includes a photosensitive drum 14, a charge device 15, a development device 16, a primary transferring roller 17 and a cleaning device 18. The four photosensitive drums 14 are disposed side by side at intervals in the left-and-right direction, and come into contact with the lower face of the intermediate transferring belt 11. The charge device 15, the development device 16, the primary transferring roller 17 and the cleaning device 18 are disposed around the photosensitive drum 14 in the order to the transferring process. The primary transferring roller 17 is provided so as to put the intermediate transferring belt 11 between the primary transferring roller 17 and the photosensitive drum 14. With the right side portion of the intermediate transferring belt 11, the secondary transferring roller 19 comes into contact to form a transferring nip between the secondary transferring roller 19 and the intermediate transferring belt 11.

A controller 9 of the color printer 1 controls each device suitably to perform an image forming operation as described later. The charge device 15 charges the surface of the photosensitive drum 14. The photosensitive drum 14 is emitted with scanning light emitted from the optical scanning device 13 to carry an electrostatic latent image. The development device 16 uses the toner supplied from the corresponding toner container 10 and develops the electrostatic latent image on the photosensitive drum 14 into a toner image. The primary transferring roller 17 primarily transfers the toner image on the photosensitive drum 14 to the rotating intermediate transferring belt 11. The intermediate transferring belt 11 carries a full color toner image, formed by overlapping the four colors toner images, while rotating. The sheet S is fed to the conveyance path 8 from the sheet feeding cassette 3 by the sheet feeding device 5. The secondary transferring roller 19 secondarily transfers the toner image on the intermediate transferring belt 11 to the sheet S passed through the transferring nip. The fixing device 7 heat-fixes the toner image to the sheet S. Then, the sheet S is discharged on the discharge tray 4. The cleaning device 18 removes the toner remaining on the photosensitive drum 14.

Figure 2:
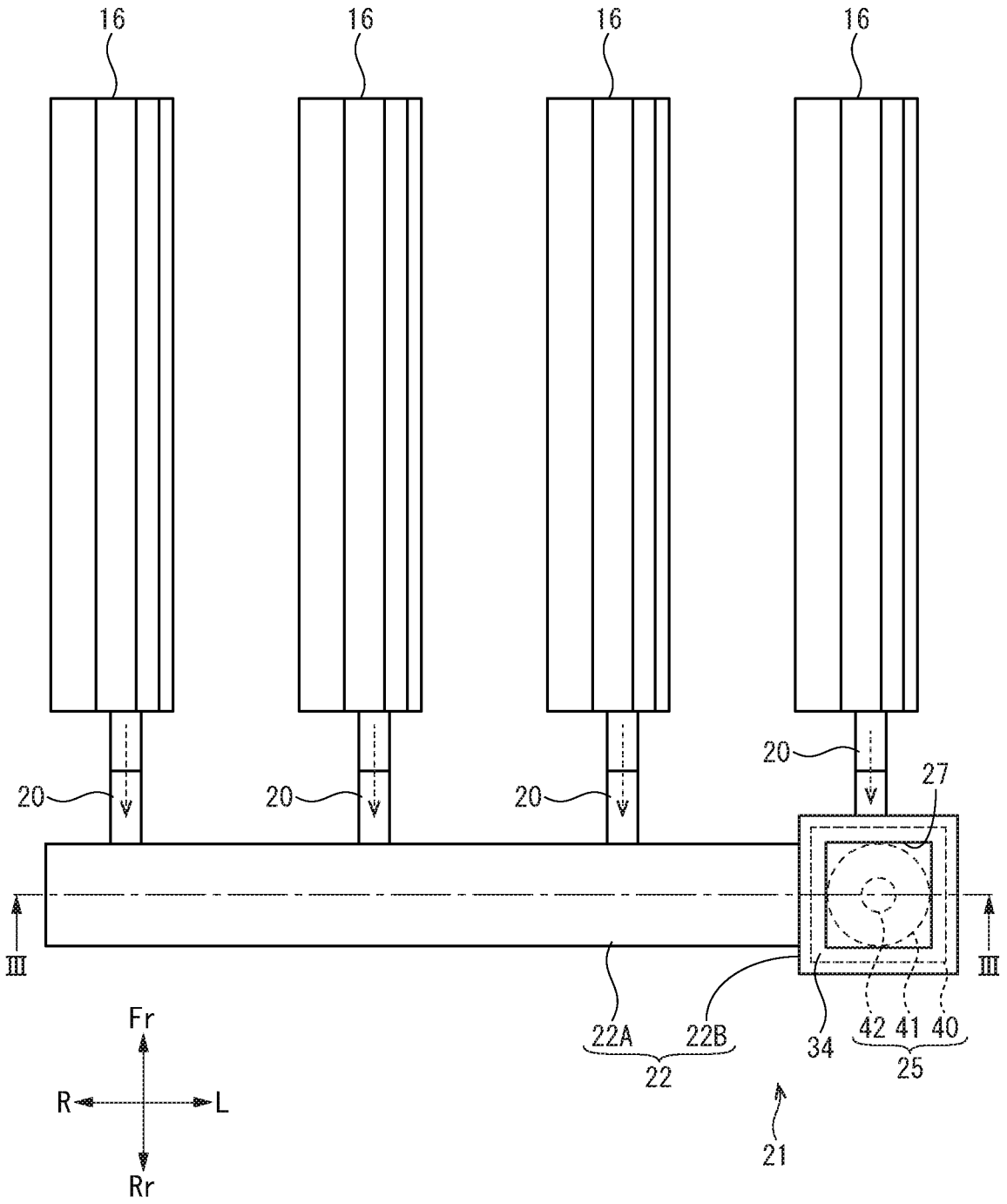
FIG. 2 is a plan view showing a development device and a toner collection device of the color printer according to the embodiment of the present disclosure.
Figure 3:
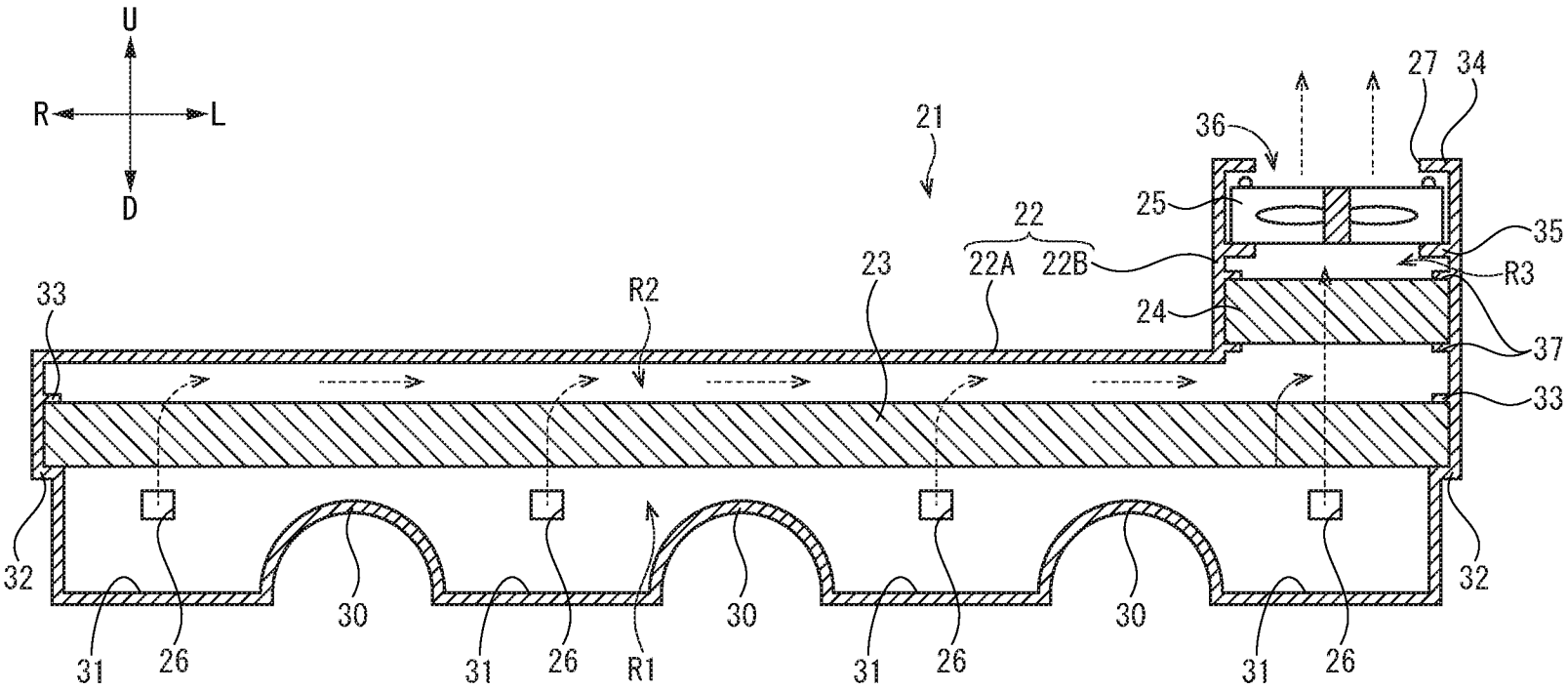
FIG. 3 is a sectional view showing the cross section of the development device and the toner collection device taken along the III-III line in FIG. 2.
Figure 4:
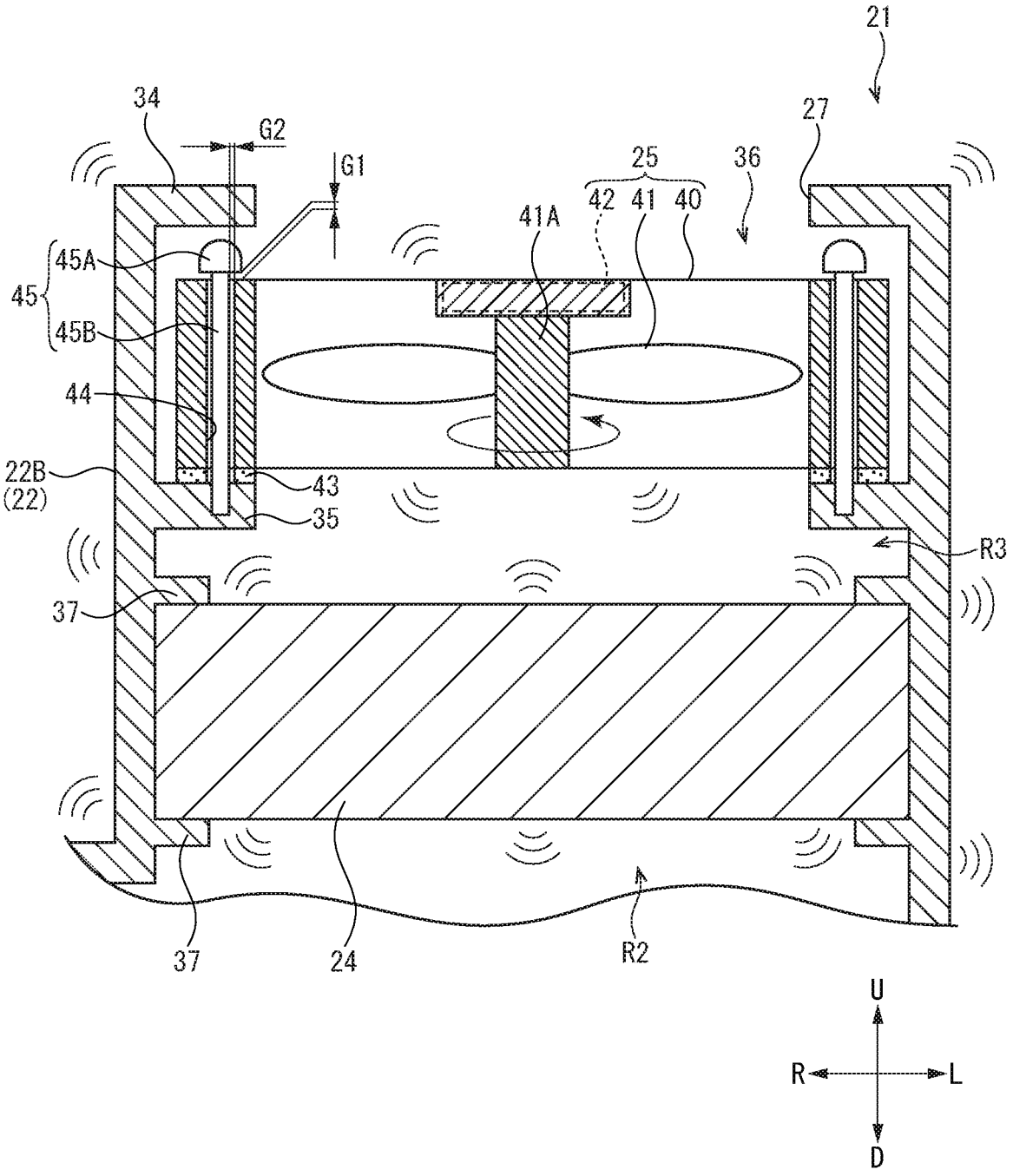
FIG. 4 is an enlarged sectional view showing a fan unit and the others of the toner collection device according to the embodiment of the present disclosure.

[Toner collection device] The color printer 1 further includes a toner collection device 21 which collects unnecessary toner from the development device 16. Hereinafter, with reference to FIG. 2 to FIG. 4, the toner collection device 21 will be described. FIG. 2 is a plan view showing the development device 16 and the toner collection device 21. FIG. 3 is a sectional view showing the cross section of the development device 16 and the toner collection device 21 taken along the III-III line in FIG. 2. FIG. 4 is an enlarged sectional view showing a fan unit 25 and the others.

As shown in FIG. 2, the toner collection device 21 is disposed on a rear side of the four development devices 16. Between the toner collection device 21 and the four development devices 16, four collection ducts 20 are provided. Each collection duct 20 is a duct which communicates a development side exhaust port (not shown) opened to the development device 16 (the casing of the development device 16) with a suction port 26 (described later) opened to the toner collection device 21.

As shown in FIG. 2 and FIG. 3, the toner collection device 21 includes a casing 22, a first filter 23, a second filter 24 and a fan unit 25. The casing 22 is formed into a hollow box-like shape, and has the suction port 26 and an exhaust port 27. The first filter 23 and the second filter 24 are fixed inside the casing 22, and collect the toner contained in air flowing into the casing 22 through the suction port 26. The fan unit 25 is supported by the casing 22 and generates air flow from the suction port 26 to the exhaust port 27 inside the casing 22. "Upstream", "downstream" and the similar terms show "upstream", "downstream" and the similar concepts of the air flow generated by the fan unit 25.

<Casing> The casing 22 contains a suction casing 22A and an exhaust casing 22B. The suction casing 22A and the exhaust casing 22B are integrally formed and, made of synthetic resin, for example. The suction casing 22A is formed into an approximately parallelepiped shape long in the left-and-right direction so as to be across the four development devices 16 (refer to FIG. 2). The exhaust casing 22B is formed into an approximately rectangular cylindrical shape protruding upward from the left portion of the suction casing 22A (refer to FIG. 3).

(Suction casing) As shown in FIG. 3, the four suction ports 26 are formed in the front face of the suction casing 22A at positions facing the development devices 16. Each suction port 26 is opened to the portion slightly lower than the center portion of the front face of the suction casing 22A in the upper-and-lower direction. To each suction port 26, each collection duct 20 extending from the corresponding development device 16 is connected. On the lower face of the suction casing 22A, three arc-shaped partitions 30 are formed. The top (the uppermost portion) of each partition 30 is positioned slightly lower than the uppermost portion of the corresponding suction port 26. The three partitions 30 are disposed at an approximately center between the adjacently disposed two suction ports 26 to divide the lower portion of the suction casing 22A into four sections. In the lower portion of the suction casing 22A, four storage parts 31 divided by the three partitions 30 are formed.

The upper portion of the suction casing 22A is formed to be slightly larger than the lower portion thereof in the front-and-rear direction and in the left-and-right direction. Then, on the inner face of the suction casing 22A, an approximately annular step face 32 is formed. Furthermore, on the inner face of the suction casing 22A, an approximately rectangular annular first fixed rib 33 is protruded at a position above the step face 32.

(Exhaust casing) As shown in FIG. 2, the exhaust casing 22B is formed to be an approximately square shape in the plan view. The approximately square annular exhaust port 27 is opened to the upper face of the exhaust casing 22B. In detail, in the upper end portion of the exhaust casing 22B, an approximately rectangular annular opened face part 34 is formed so as to surround the exhaust port 27. As shown in FIG. 3 and FIG. 4, on the inner face of the exhaust casing 22B, an approximately rectangular annular supporting face part 35 is formed at a position below the opened face part 34. As described later in detail, between the opened face part 34 and the supporting face part 35, a disposing space 36 in which the fan unit 25 is disposed is formed. Below the disposing space 36, a pair of upper and lower second fixed ribs 37 is protruded on the inner face of the exhaust casing 22B below the disposing space 36. The second fixed ribs 37 each having an approximately rectangular annular shape are disposed at positions separate away in the upper-and-lower direction.

<First filter> As shown in FIG. 3, the first filter 23 is formed into a thick plate-like shape. The first filter 23 is a dust collection filter formed by glass fivers having a diameter to 1 to 10 μm, for example. The first filter 23 is fitted into a space between the step face 32 and the first fixed rib 33 in a state where its movement is restricted. The first filter 23 divides the inside of the suction casing 22A into upper and lower rooms. In detail, the inside of the suction casing 22A is divided by the first filter 23 into a dirty room R1 and a clean room R2. The dirty room R1 is formed below (the upstream side of) the first filter 23 and the clean room R2 is formed above (the downstream side of) the first filter 23.

<Second filter> As shown in FIG. 3 and FIG. 4, the second filter 24 is a dust collection filter formed into a thick plate-like shape, in the same manner as the first filter. The second filter 24 is formed into be an approximately square shape smaller than the first filter 23 in a plan view. The second filter 24 is formed to be finer (the gaps between the filters are smaller) than the first filter 23 so as to be capable of collecting a dust finer than the first filter 23.

The second filter 24 is fitted between the upper and lower second fixed ribs 37 in a state where its movement is restricted. The second filter 24 divides the inside of the exhaust casing 22B into upper and lower rooms. In detail, the inside of the exhaust casing 22B is divided by the second filter 24 into a first clean room R2 and a second clean room R3. As describe above, the first clean room R3 is a pace above the first filter 23 and connected to the lower end portion of the exhaust casing 22B. The second clean room R3 is formed above (the downstream side of) the second filter 24. The second clean room R3 is a space between the second filter 24 and the disposing space 36 (the fan unit 25).

<Fan unit> The fan unit 25 is a propeller fan which generates air flow by a rotating rotary blade 41. As shown in FIG. 4, the fan unit 25 contains a fan case 40, the rotary blade 41 and a fan motor 42.

(Fan case) The fan case 40 is formed into a thick plate-like shape or an approximately parallelepiped shape, and is made of synthetic resin, for example. The fan case 40 is disposed in the disposing space 36 between the opened face part 34 and the supporting face part 35. The fan case 40 is formed to be one size smaller than the disposing space 36, and allowed to be moved slightly in the disposing space 36 in the upper-and-lower direction, in the front-and-rear direction and in the left-and-right direction. The fan case 40 is disposed on the supporting face part 35 via a seal member 43. The seal member 43 is formed into an approximately rectangular annular shape corresponding to the supporting face part 35, and made of elastically deformable material such as sponge and synthetic rubber.

At the four corner portions of the fan case 40, four through holes 44 penetrating in the upper-and-lower direction (an axial direction perpendicular to the supporting face part 35) are formed. Each through hole 44 is a circular hole through which a supporting pin 45 is passed in the upper-and-lower direction. Each supporting pin 45 contains a head portion 45A formed to be unable to be inserted into the through hole 44 and a main body 45B extending downward from the head portion 45A. The main body 45B is formed to be an approximately columnar shape smaller (finer) than the through hole 44. Thereby, the main body 45B is inserted into the through hole 44 with looseness. The main body 45B is longer than the through hole 44 (the height (the thickness) of the fan case 40), and the tip end portion of the main body 45B is passed through the through hole 44 (and the seal member 43) and fixed to the supporting face part 35. The tip end portion of the main body 45B may be press-fitted into a hole formed in the supporting face part 35 or adhered to the hole with adhesive. Alternatively, the tip end portion of the main body 45B is formed to have a male screw and the hole of the supporting face part 35 is formed to have a female screw, and the tip end portion of the main body 45B is fixed to the supporting face part 35 by a screw action (the example is not shown). Alternatively, the screwed tip end portion of the main body 45B may be passed through the hole penetrating the supporting face part 35, and the tip end portion of the main body 45B protruding downward from the supporting face part 35 may be engaged with a nut (the example is not shown).

In the present embodiment, as an example, between the upper face of the fan case 40 and the lower face of the head portion 45A, a gap G of about 1 mm is formed. As an example, the through hole 44 has a diameter larger than the main body 45B by about 1 mm, and between the inner circumferential face of the through hole 44 and the main body 45B, a gap G2 of about 0.5 mm is formed in a radial direction in a state where the through hole 44 and the main body 45B are coaxially disposed. As described above, the fan case 40 is supported by the supporting face part 35 with looseness via each supporting pin 45. That is, the fan unit 25 is supported in a swingable manner with respect to the casing 22. In the present embodiment, the fan unit 25 is moved by about 1 mm with respect to the casing 22. However, the moving range (the length of the looseness) can be suitably changed depending on various parameters such as a size or a weight of the fan unit 25 and the others.

(Rotary blade, fan motor) The rotary blade 41 is fixed on the outer circumferential face of a rotational shaft 41A extending in the upper-and-lower direction. The rotational shaft 41A is supported by the axial center portion of the fan case 40 in a rotatable manner. The fan motor 42 is fixed to the axial center portion of the fan case 40, and an output shaft (not shown) of the fan motor 42 is coupled to the rotational shaft 41A. A drive force (a rotational force) of the fan motor 42 rotates the rotational shaft 41A (the rotary blade 41), and the rotating rotary blade 41 generates an air flow from the lower side to the upper side. The fan motor 42 is electrically connected to the controller 9 to be controlled to be driven.

[Operation of toner collection device] Next, with reference to FIG. 2 to FIG. 4, an operation of the toner collection device 21 will be described. Firstly, a toner collection operation of the toner collection device 21 will be described.

When the above described image forming operation is performed, the controller 9 drives the fan motor 42. Then, the rotary blade 41 is rotated to generate the air flow from the insides of the four development devices 16 to the inside of the casing 22 (refer to the broken line arrow in FIG. 2). The air containing the toner inside each development device 16 is flowed in the dirty room R1 in the casing 22 from the suction port 26 through the collection duct 20 (refer to the broken line arrow in FIG. 3).

The air flowed into the dirty room R1 is flowed into the first clean room R2 through the first filter 23 (refer to the broken line arrow in FIG. 3) so that most of the toner contained the air is collected by the first filter 23. Then, the air flowed into the first clean room R2 is flowed toward the exhaust casing 22B, and then into the second clean room R3 through the second filter 24 (refer to the broken line arrow in FIG. 3). Then, the toner which is not collected by the first filter 23 is collected by the second filter 24.

The air containing the toner is filtered while passing through the first and second filters 23 and 24 to become clean air. The clean air is passed through the fan unit 25 (the disposing space 36) and then exhausted to the outside of the casing 22 from the exhaust port 27 (refer to the broken line arrow in FIG. 3). The exhausted clean air is used to cool devices provided inside the apparatus main body 2 and then discharged outside the apparatus main body 2. As described above, the toner collection device 21 removes the toner contained in the air so that it becomes possible to inhibit the contamination of the inside and the outside of the apparatus main body 2 by the scattered toner.

By the way, when the first and second filters 23 and 24 are clogged with the toner, a toner collection performance is conventionally decreased. Especially, because the first filter 23 disposed downstream collects a large amount of the toner, the first filter 23 is easily clogged with the toner. Furthermore, when used for a long period, the second filter 24 is also clogged with the toner. To considering such a problem, the toner collection device 21 of the present embodiment is provided with a mechanism to vibrate the first and second filters 23 and 24 and to shake the collected toner.

<Vibrating filter> As described above, the fan case 40 of the fan unit 25 is not tightly fixed to the supporting face part 35 but loosely attached to the supporting face part 35. Thereby, when the fan motor 42 is driven (rotated) in order to generate the air flow, the fan unit 25 (the fan case 40) is irregularly swung (vibrated) by inertial moment owing to the rotation of the fan motor 42 and the rotary blade 41. In detail, as shown in FIG. 4, the fan unit 25 is swung in the upper-and-lower direction within the gap G1 between the head portion 45A and the supporting face part 35 and in a radial direction (the front-and-rear direction, the left- and right direction) within the gap G2 between the main body 45B and the inner circumferential face of the through hole 44. The swinging of the fan unit 25 driven to generate the air flow is transmitted to the first and second filters 23 and 24 via the casing 22 to vibrate the first and second filters 23 and 24.

When the first and second filters 23 and 24 are vibrated, the toner collected by the first and second filters 23 and 24 is shaken out off the first and second filters 23 and 24. The toner shaken off the first filter 23 is stored in the four storage parts 31 (refer to FIG. 3). The toner shaken off the second filter 24 is collected by the first filter 23, shaken off the first filter 23 by vibrating the first filter 23 and then stored in the storage parts 31.

The controller 9 may stop the driving of the fan motor 42 after the image forming operation is finished, or may continue the driving of the fan motor 42 for a predetermined period after the image forming operation is finished. Alternatively, the controller 9 may repeat increase and decrease of the rotation number of the fan motor 42 to provide a pulsing motion to the first and second filters 23 and 24.

The toner collection device 21 of the above described embodiment has a configuration such that the fan unit 25 is loosely supported by the casing 22 and swung itself when driven. According to the configuration, the swinging of the fan unit 25 is transmitted to the first and second filters 23 and 24 to vibrate the first and second filters 23 and 24, so that it becomes possible to shake the collected toner off the first and second filters 23 and 24. Thereby, it becomes possible to prevent the clogging of the first and second filters 23 and 24. Additionally, the fan unit 25 is used as a generation source of the air flow and as a swinging source of the first and second filters 23 and 24 so that it becomes possible to inhibit the increase of the manufacturing cost of the toner collection device 21 compared with a case where a swinging source of the first and second filters 23 and 24 is separately provided. Additionally, although a space to dispose the swinging source is required in a case where the swinging source is separately provided, the toner collection device 21 of the present embodiment does not requires such unnecessary space so that it becomes possible to suppress the increase in size of the toner collection device 21.

According to the toner collection device 21 of the present embodiment, it becomes possible to support the fan unit 25 to the casing 22 loosely by a simple structure in which the fan unit 25 (the fan case 40) is attached to the supporting face part 35 by the supporting pin 45

According to the toner collection device 21 of the present embodiment, the toner removed from the first and second filters 23 and 24 is stored in each storage parts 31 so that the stored toner can be collected together.

[Modified example] Next, a modified example of the toner collection device 21 of the present embodiment will be described. In the following description, the same structures as or the corresponding structures to the toner collection device 21 of the above embodiment are shown with the same reference number as the above embodiment, and the same description as and the corresponding description to the description of the toner collection device 21 are omitted.

Figure 5:
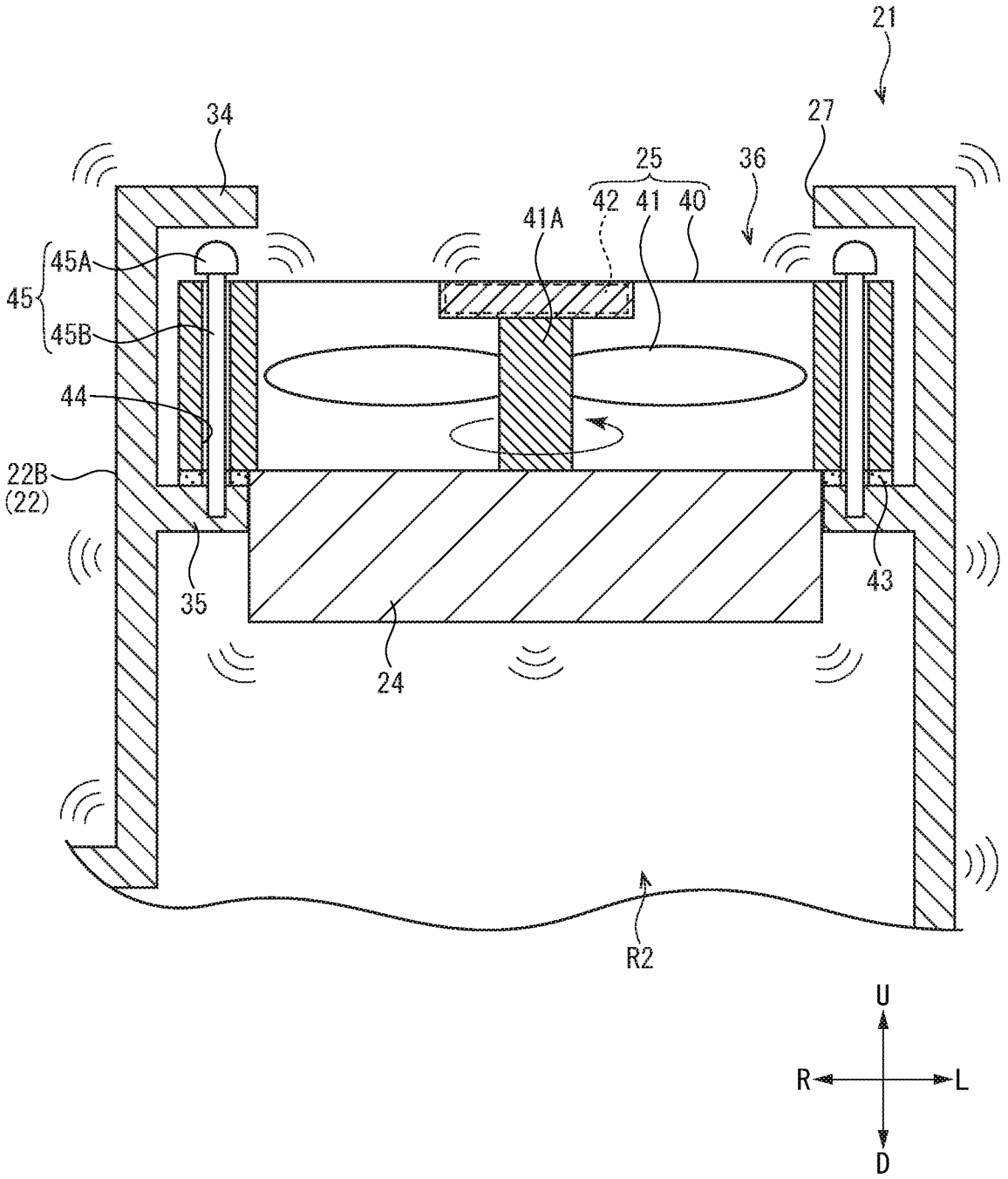
FIG. 5 is an enlarged sectional view showing the fan unit and the others of the toner collection device according to a first modified example of the embodiment of the present disclosure.

<First modified example> In the toner collection device 21 of the above described present embodiment, although the first and second filters 23 and 24 are fixed to the casing 22, the present disclosure is not limited thereto. As the toner collection device 21 of the first modified example, as shown in FIG. 5, the second filter 24 may be fixed to the fan unit 25 (the fan case 40). Alternatively, the fan unit 25 may be separately provided in the inside of the suction casing 22A and the first filter 23 may be fixed to the fan unit 25 (the example is not shown). That is, the first and second filters 23 and 24 may be fixed to at least one of the casing 22 and the fan unit 25 inside the casing 22.

Figure 6:
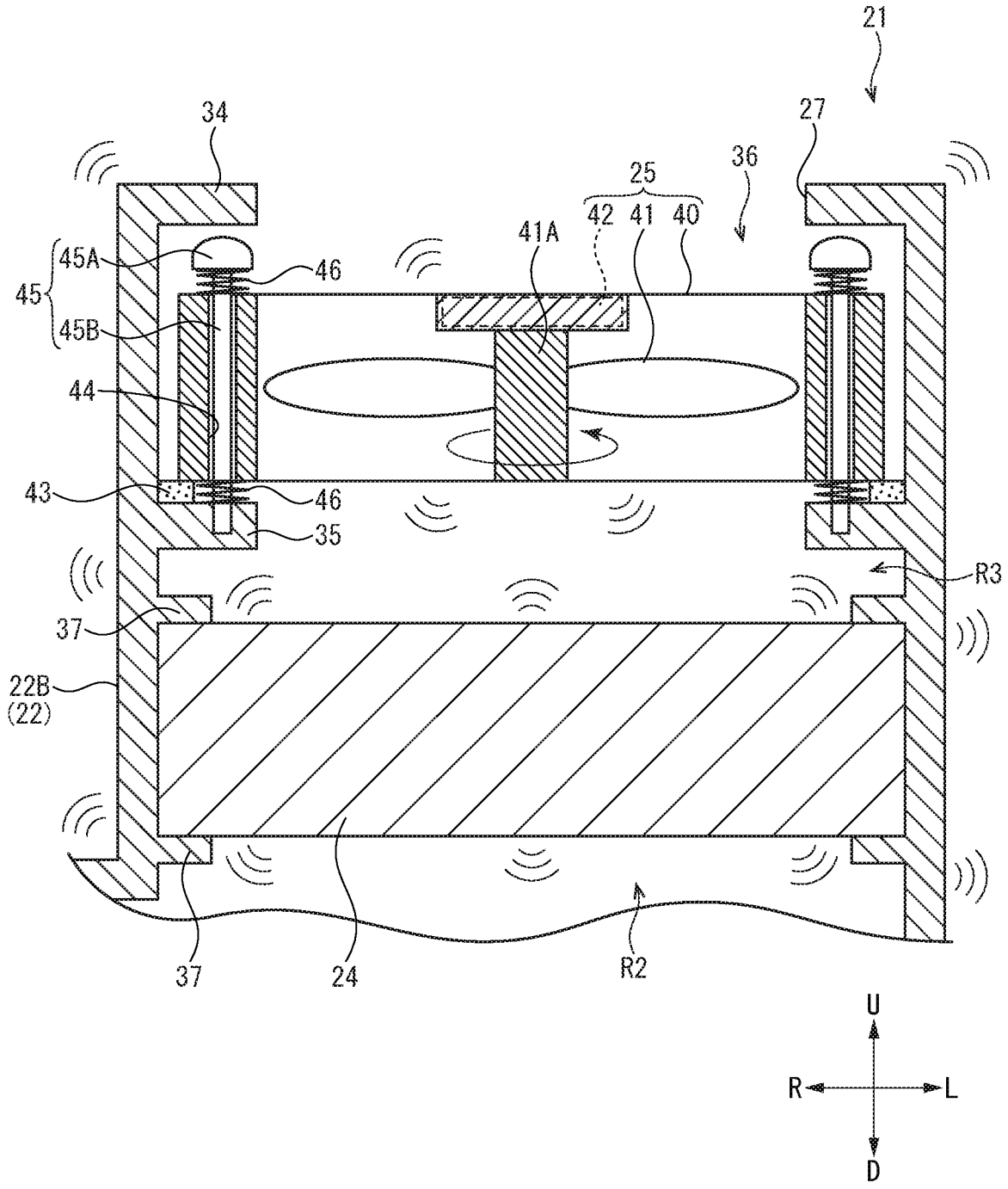
FIG. 6 is an enlarged sectional view showing the fan unit and the others of the toner collection device according to a second modified example of the embodiment of the present disclosure.

<Second modified example> In the toner collection device 21 of the above described present embodiment, although the first and second filters 23 and 24 are fixed to the casing 22, the present disclosure is not limited thereto. As the toner collection device 21 of the second modified example, as shown in FIG. 6, a plurality of coil springs 46 (a compression spring (an elastic member)) may be provided around the supporting pins 45 (the main body 45B). Specifically, the coil springs 46 is provided between the lower face of the fan case 40 and the upper face of the supporting face part 35 and between the upper face of the fan case 40 and the lower face of the head portion 45A. Each coil spring 46 is elastically deformed in the upper-and-lower direction and deflected in a radial direction. Either one of the coil spring 46 on the upper face of the fan case 40 and the coil spring 46 on the lower face of the fan case 40 may not be provided.

Figure 7:
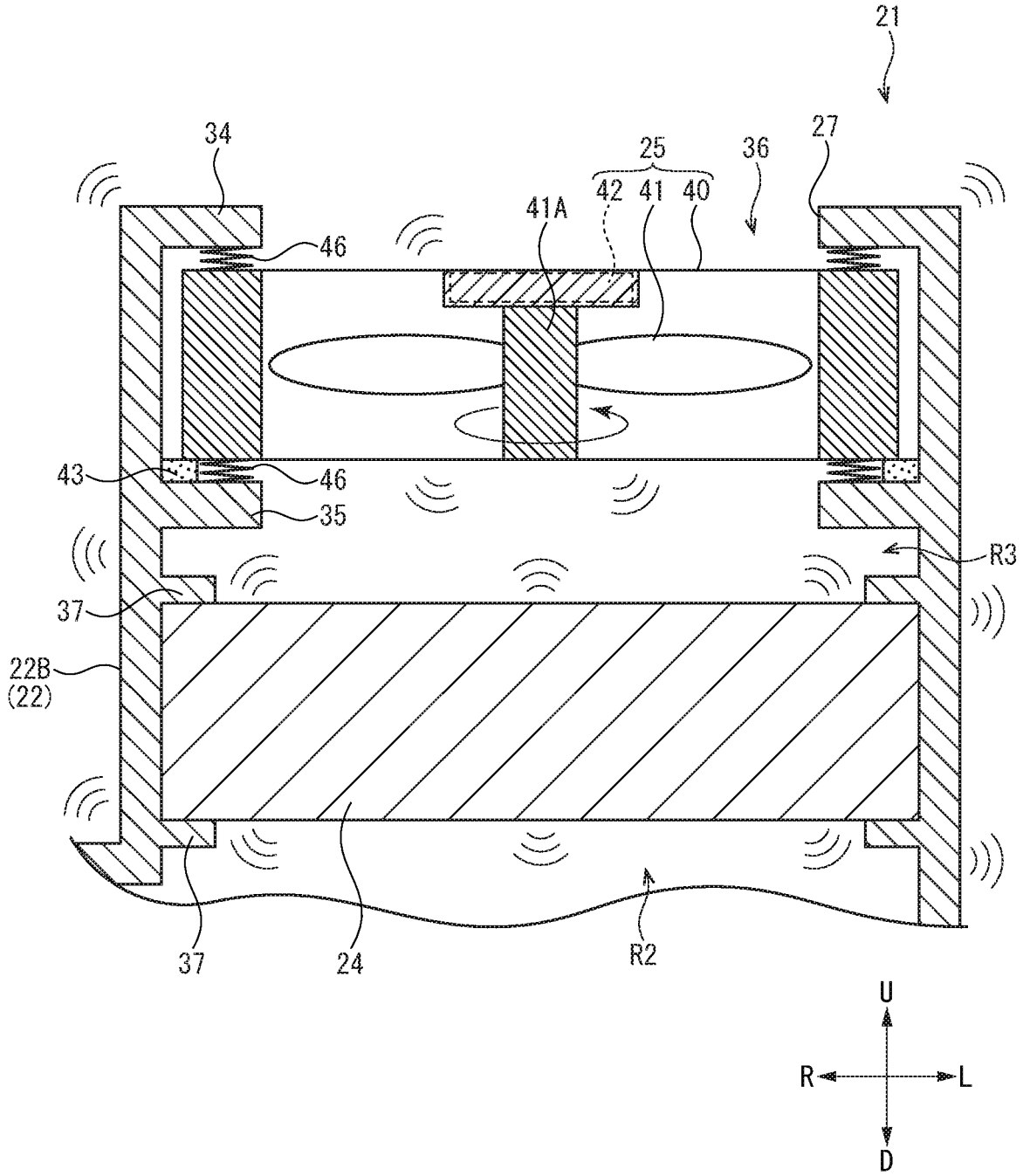
FIG. 7 is an enlarged sectional view showing the fan unit and the others of the toner collection device according to a third modified example of the embodiment of the present disclosure.

<Third example> In the same purpose as the second modified example, as the toner collection device 21 of the third example, as shown in FIG. 7, the supporting pin 45 may not be provided and the fan unit 25 (the fan case 40) may be supported by the casing 22 (the opened face part 34, the supporting face part 35) via the coil spring 46 (the elastic member) deformable in the upper-and-lower direction and in the radial direction.

According to the toner collection devices 21 of the second and third embodiments, the fan unit 25 is supported by the casing 22 via the coil spring 46 so that it becomes possible to suppress the fan unit 25 from being forcefully abutted on the supporting face part 35 and the head portion 45A. Thereby, it becomes possible to vibrate the first and second filters 23 and 24 while inhibiting the fan unit 25 from being damaged. In the second and third modified examples, the coil spring 46 is used as the elastic member. The elastic member is not limited to the coil spring and a rubber member may be used (the example is not shown).

Figure 8:
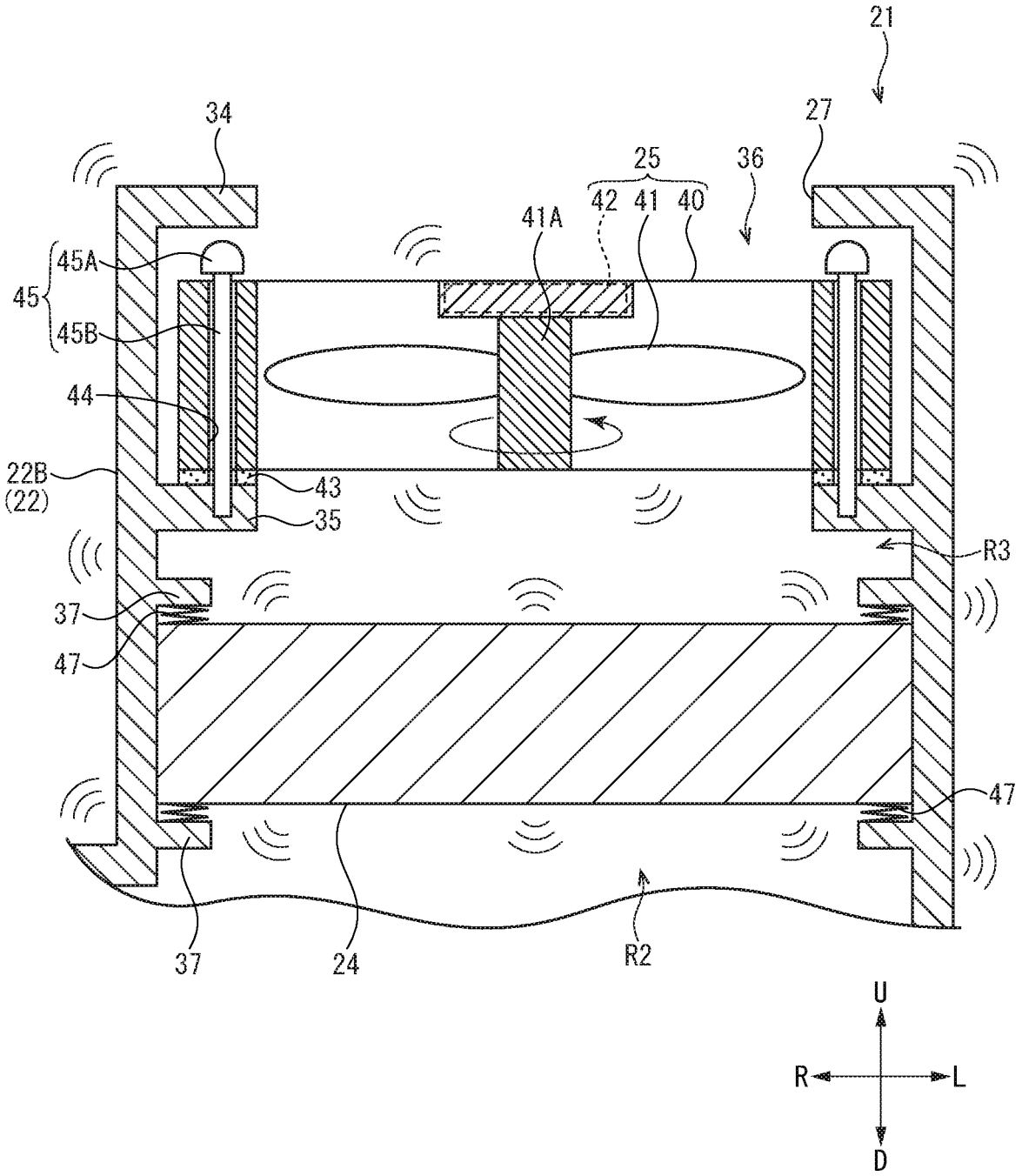
FIG. 8 is an enlarged sectional view showing the fan unit and the others of the toner collection device according to a fourth modified example of the embodiment of the present disclosure.

<Fourth modified example> In the toner collection device 21 of the above described present embodiments, although the first and second filters 23 and 24 are fixed to the casing 22, the present disclosure is not limited thereto. As the toner collection device 21 of the fourth modified example, as shown in FIG. 8, the second filter 24 may be supported by the casing 22 via an elastic member such as a coil spring 47. In this case, it is preferable to use the coil spring 47 having a strong elastic force so as not to absorb the vibration excessively. The elastic member is not limited to the coil spring 47 and a hard rubber member may be used. Furthermore, the second filter 24 may be supported by the fan unit 25 via the coil spring 47 or the like. The first filter 23 may be supported by the casing 22 (or the fan unit 25) via an elastic member such as the coil spring 47 (The example is not shown).

Figure 9:
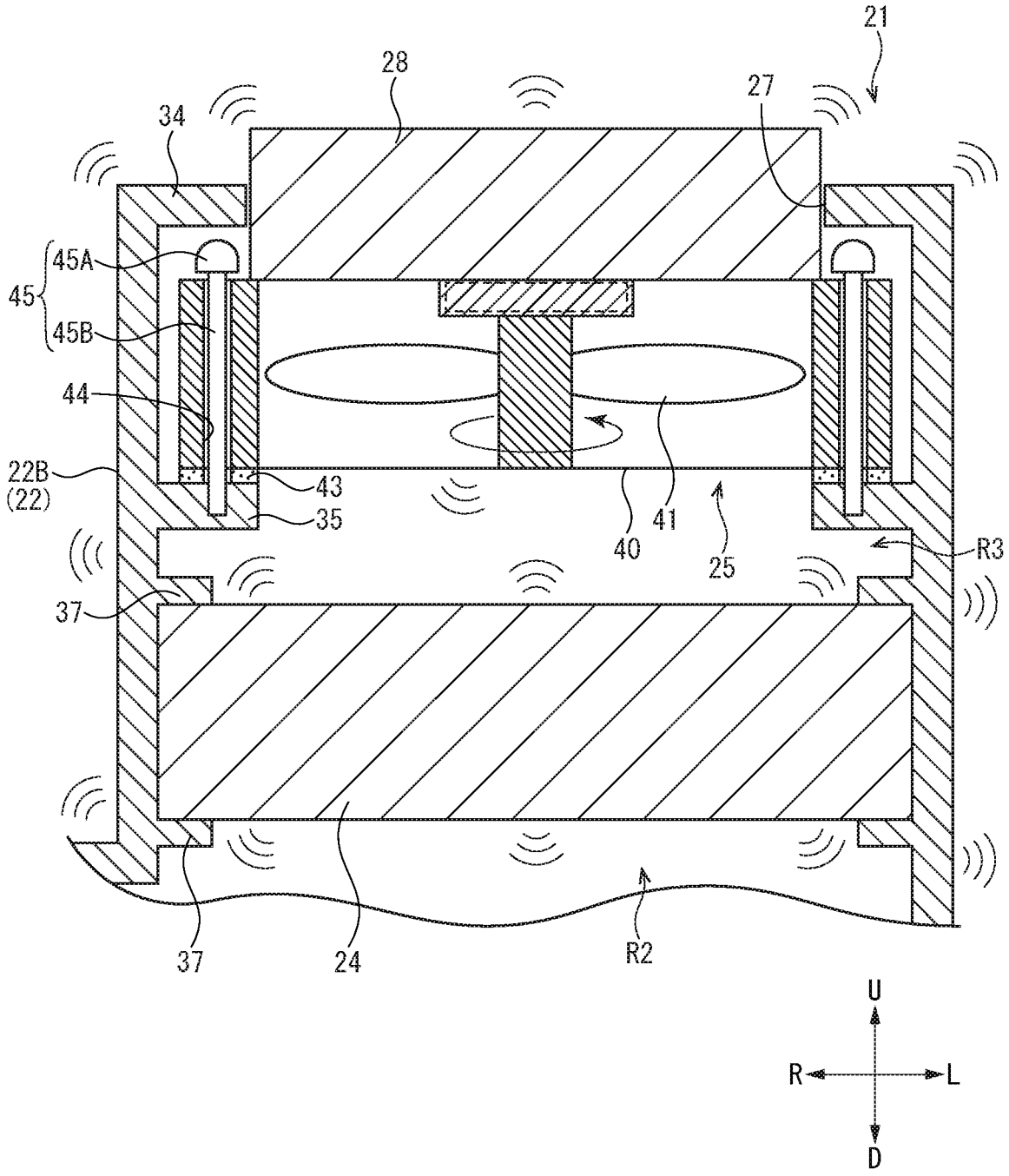
FIG. 9 is an enlarged sectional view showing the fan unit and the others of the toner collection device according to a fifth modified example of the embodiment of the present disclosure.

<Fifth modified example> As the toner collection device 21 of the fifth modified example, as shown in FIG. 9, an option filter 28 may be disposed on a downstream side of the fan unit 25. The option filter 28 is fixed to the upper face of the fan unit 25 (the fan case 40). The option filter 28 collects the toner passed through the second filter 24 and the others. According to the toner collection device 21 of the fourth modified example of the present embodiment, the option filter 28 is disposed on a downstream side of the fan unit 25 so that the toner passed through the second filter 24 can be collected by the option filter 28. Thereby, it becomes possible to prevent the leakage of the toner to the outside of the casing 22. The option filter 28 may be fixed to the casing 22 not but the fan unit 25 (the example is not shown). The option filter has almost the same mash size as the second filter 24.

The characteristics of the toner collection devices 21 of the first to fifth embodiments may be combined.

Although the toner collection device 21 of the present embodiment (containing the first to fourth modified examples, the same applies to the following) is provided with the first filter 23 and the second filter 24, the present disclosure is not limited thereto. The toner collection device 21 may be provided with at least one filter, and either one of the first filter 23 and the second filter 24 may not be provided (the example is not shown).

In the toner collection device 21 of the present embodiment, one fan unit 25 is provided. However, a plurality of the fan units 25 may be provided (the example is not shown). In this case, at least one of the fan units 25 may be loosely supported by the casing 22.

The toner collection device 21 of the present embodiment is provided with the propeller type fan unit 25, but other types of the fan, such as sirocco fan, may be used.

The toner collection device 21 of the present embodiment is connected to the development device 16 via the collection duct 20. However, the present disclosure is not limited thereto. For example, the collection duct 20 may not be connected to the development device 16 and the upstream end port of the collection duct 20 may be disposed near the development device 16. In this case, the toner collection device 21 will collect the toner scattering (flowing) outside the development device 16. The toner collection device 21 is disposed near the development device 16. However, the present disclosure is not limited thereto, and may be disposed at a portion where the toner is scattered or flowed, such as a portion near the toner container 10.

Furthermore, in the description of the above embodiments, the case where the present disclosure is applied to the color printer 1 is described as an example, but the present disclosure is not limited thereto, and may be applied to a monochrome printer, a copying machine, a facsimile and a multifunctional peripheral, for example.

The description of the above embodiment shows one aspect of the toner collection device and the image forming apparatus of the present disclosure, and the technical scope of the present disclosure is not limited to the above embodiment.

The invention claimed is:

1. A toner collection device comprising:

a casing having a suction port and an exhaust port;

a fan unit supported by the casing in a swingable manner and generating an air flow from the suction port to the exhaust port inside the casing;

a supporting pin that supports the fan unit to the casing; and a filter disposed inside the casing and supported by the casing or the fan unit, and collecting a toner contained in the air flow flowed into the casing through the suction port, wherein the fan unit includes a fan case having a through hole through which the supporting pin is configured to be inserted, a rotary blade supported by the fan case in a rotatable manner, and a fan motor supported by the fan case and rotating the rotary blade, the supporting pin includes:

a head portion having an outer diameter larger than an inner diameter of the through hole, a main body having an outer diameter smaller than the inner diameter of the through hole and inserting through the through hole, a tip end portion passing through the through hole being fixed to the casing, and gaps formed between the head portion and the fan case and between the through hole and the main body, and when the fan motor is driven and rotates the rotary blade to generate the air flow, the fan case swings in an axial direction of the main body within the gap between the head portion and the fan unit and in a direction perpendicular to the axial direction within the gap between the through hole and the main body, and a swinging of the fan case is transmitted to the filter via the casing to vibrate the filter.

2. The toner collection device according to claim 1, wherein the through hole is formed along an axial direction of the rotational shaft.

3. The toner collection device according to claim 1, wherein the fan unit is supported by the supporting face part via an elastic member deformable in the axial direction and a radial direction perpendicular to the axial direction.

4. The toner collection device according to claim 1, wherein the casing has a storage part in which the toner shaken off the filter is stored.

5. The toner collection device according to claim 4, wherein the storage part is disposed below the suction port.

6. The toner collection device according to claim 1, further comprising an option filter disposed on a downstream side of the fan unit in a direction of the air flow, fixed to the casing or the fan unit and collecting the toner passed through the filter.

7. The toner collection device according to claim 1 wherein, the suction port is communicated with a development device, the casing is divided into a portion where the fan unit and the filter are supported and a portion where the suction port is provided, and both the portions are air-tightly connected.

8. An image forming apparatus comprising the toner collection device according to claim 1.

* * * * *